US006636715B2

(12) United States Patent
Kawamura et al.

(10) Patent No.: US 6,636,715 B2
(45) Date of Patent: Oct. 21, 2003

(54) PHOTOSENSITIVE MEMBER AND IMAGE FORMING APPARATUS HAVING THE SAME

(75) Inventors: Kunimasa Kawamura, Shizuoka (JP); Koji Yamazaki, Kanagawa (JP); Toshiyuki Ehara, Kanagawa (JP); Masaya Kawada, Shizuoka (JP); Tetsuya Karaki, Shizuoka (JP); Hironori Owaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/861,579

(22) Filed: May 22, 2001

(65) Prior Publication Data

US 2002/0034700 A1 Mar. 21, 2002

(30) Foreign Application Priority Data

May 22, 2000 (JP) ..... 2000-150139

(51) Int. Cl.[7] ..... G03G 15/02; G03G 5/082

(52) U.S. Cl. ..... 399/176; 430/66; 399/150; 399/159

(58) Field of Search ..... 430/66, 67, 69; 399/159, 150, 176

(56) References Cited

U.S. PATENT DOCUMENTS 5,561,021 A 10/1996 Yamazaki et al. ..... 430/130
5,963,762 A * 10/1999 Furuya et al. ..... 430/159
6,108,502 A 8/2000 Kawada et al. ..... 399/159
6,128,456 A 10/2000 Chigono et al. ..... 399/176
6,171,742 B1 1/2001 Kawada et al. ..... 430/67
2001/0051308 A1 * 12/2001 Kawamura et al. ..... 430/66
2002/0037464 A1 * 3/2002 Kawada et al. ..... 430/66

FOREIGN PATENT DOCUMENTS

JP 118741 4/1994
JP 129266 5/1996
JP 297420 11/1997
JP 307455 11/1998

* cited by examiner

*Primary Examiner*—Janis L. Dote
(74) *Attorney, Agent, or Firm*—Fitzpatrick, Cella, Harper & Scinto

(57) ABSTRACT

To provide an amorphous Si photosensitive member and an image forming apparatus which form favorable images by preventing toner adhesion at a cleaning time. A photoconductive layer 102 containing amorphous Si is formed on an electrically conductive substrate 101 so that a surface of a photosensitive member has an average inclination Δa within a range of 0.12 to 1.0, more preferably 0.15 to 0.8 within a range of 10 μm×10 μm, and an electrically conductive substrate has surface roughness Ra within the range of 10 μm×10 μm is lower than 9 nm, preferably lower than 6 nm.

7 Claims, 12 Drawing Sheets

PHOTOSENSITIVE MEMBER AND IMAGE FORMING APPARATUS HAVING THE SAME

BACKGROUND OF THE INVENTION

1. Field of the Invention

The present invention relates to a photosensitive member and an image forming apparatus, and more specifically a photosensitive member usable for electrophotography which is configured by consecutively laminating a photoconductive layer containing amorphous Si and a surface protective layer, and an image forming apparatus comprising the photosensitive member according to the present invention.

2. Related Background Art

An electrophotographic apparatus comprising an image forming apparatus such as a copier, a facsimile or a printer forms a copied image or the like by uniformly charging an outer circumferential surface of a photosensitive member having a substrate on a surface of which a photoconductive layer is disposed by charging means for roller charging, fur brush charging or magnetic brush charging, and then exposing an image to be copied of an object to be copied to reflected rays, a laser corresponding to a modulated signal or an LED to form an electrostatic latent image on the outer circumference of the above described photosensitive member, further adhering a toner to the above described photosensitive member to form a toner image and transferring the toner image to copying paper or the like.

After the image is formed by the electrophotographic apparatus as described above, the toner partially remains on the photosensitive member and it is necessary to remove the residual toner. It is general to remove such residual toner at a cleaning step using a cleaning blade, a fur brush, a magnet brush or the like.

By the way, there has recently been proposed and disclosed electrophotographic apparatuses which use no cleaning device so as to produce waste toner in a smaller amount of toner or no waste toner for solicitudes of environments. This type electrophotographic apparatuses are classified into those such as an apparatus disclosed by Japanese Patent Application Laid-Open No. 6-118741 which uses a direct charger such as a brush charger serving for both charging step and a cleaning step, those such as an apparatus disclosed by Japanese Patent Application Laid-Open No. 10-307455 which uses a developing apparatus serving for both a developing step and a cleaning step and others: any apparatus using a step of removing unwanted toner from a surface of a photosensitive member by rubbing the toner with the surface of the photosensitive member.

In recent years where toners which have average particle diameters smaller than conventional are used for enhancing qualities of printed images and toners which have fusion points lower than conventional are used for energy saving, however, it is difficult to remove the residual toner at a toner removing step which is proceeded simultaneously with another process, whereby a problem of toner adhesion may be posed that the above described residual toner interlocks with a surface of a photosensitive member as a result of repeated image formation, thereby producing an image defect of black spots or white spots.

As a measure to solve the above described problem, there has been proposed a method which uses a photosensitive member having amorphous Si as a photosensitive layer and preliminarily roughens, by cutting or with a rotary ball mill, a surface of an electrically conductive substrate on which the above described photosensitive layer is to be formed as disclosed by Japanese Patent Application Laid-Open No. 9-297420, and surface roughness of the substrate as measured with a surface roughness meter is specified on the order of micrometers.

In Japanese Patent Application Laid-Open No. 8-129266, a worked form of an electrically conductive substrate is specified as a value of an average inclination angle θa measured with a surface roughness meter in an evaluation length on the order of millimeters. Furthermore, the value corresponds to 0.0035 to 0.0524 in terms of an average inclination Δa.

Furthermore, progresses which have been made in digital electrophotographic apparatuses is forming a main stream of latent image formation with a light source emitting rays having a wavelength such as a laser, an LED or the like. As a result, the above described method which preliminarily cuts the substrate may pose a problem that exposing rays incident on the electrically conductive layer are different dependently on the form of the substrate, thereby forming stripe patterns (interference fringe) on a printed image. Furthermore, a cost is enhanced by newly adding a step of preliminarily roughening the surface of the electrically conductive substrate. When the substrate is worked to roughness within a range where the above described stripe patterns are not produced, in contrast, it may not possible to sufficiently the toner adhesion.

SUMMARY OF THE INVENTION

An object of the present invention is to provide a photosensitive member and an image forming apparatus having the photosensitive member which are free from image degradation due to useless toner adhesion to a photosensitive member or a problem due to improper cleaning and capable of maintaining performance for image sharpness not only of an analog image but also of a digital image for a long time.

Furthermore, an object of the present invention is to provide a photosensitive member and an image forming apparatus which prevent a toner from adhering at a cleaning step, thereby providing a favorable image.

Another object of the present invention is to provide a photosensitive member which is composed by laminating a photosensitive layer containing at least amorphous Si and a surface protective layer consecutively on an electrically conductive substrate and has an average inclination Δa of 0.12 to 1.0 within a range of 10 μm×10 μm as well as an image forming apparatus which has the photosensitive member.

The present invention which accomplishes the above described objects is achieved on the basis of a finding that a toner adhesion preventing effect is not always determined by surface roughness of an electrically conductive substrate on the order of micrometers dependent on a worked form of the substrate as measured with a surface roughness meter, but largely dependent rather on microscopic surface roughness (specifically on the order of several nanometers to tens of nanometers) of amorphous Si film (film having a non-single crystal (preferably amorphous) material containing silicon as a parent body). Furthermore, the present invention is based on a finding of a significant correlation between an average inclination Δa calculated from this surface shape and the toner adhesion preventing effect.

The average inclination Δa within the range of 10 μm×10 μm indicates a result which is measured with an atomic force microscope (Q-SCOPE 250 (version 3.181) manufactured by Quesant Co.) and it is preferable to measure microscopic surface roughness within a measuring range of 10 μm×10 μm for obtaining a result with a high accuracy and a high repeatability. Furthermore, it is preferable to carry out correction (tilt removal) of a result obtained with Q-SCOPE 250 manufactured by Quesant Co. to prevent an error from being involved due to curvature and an inclination of a sample. Specifically, a correction (parabolic) for flattening curvature of an AFM image is carried out by fitting the image to a parabolic curve and a correction (line by line) for flattening an inclination is carried out. This technique is preferable for the photosensitive member which is cylindrical. It is possible to appropriately correct an inclination of a sample within a range where data is not distorted as described above.

By controlling the average inclination Δa of the amorphous Si photosensitive member measured as described above, it is possible to provide an electrophotographic photosensitive member which is capable of effectively preventing toner adhesion and forming an image which has extremely high quality.

In addition, it is more preferable that the above described average inclination Δa has a value within a range of 0.15 to 0.8.

Furthermore, it is possible to prevent the toner adhesion effectively by using a photoconductive layer which is composed of a plurality of layers in addition to a substrate having the above surface roughness.

A variation of a substantial absorption depth for image exposure which is caused by a band gap of the photoconductive layer may produce potential ununiformity of an electrostatic latent image, specifically a residual potential and a ghost potential, whereby fog is produced as a core of the toner adhesion or image sharpness is aggravated.

Furthermore, it is possible to prevent the toner adhesion more effectively by continuously changing a composition in an interface region between the surface protective layer and the photosensitive layer of the photosensitive member.

Specifically, it is desirable to satisfy the following equation (1):

$$0 \leqq (Max-Min)/(Max+Min) \leqq 0.4 \quad (1)$$

where Max (%) denotes a maximum value and Min (%) denote a minimum vale of spectral reflectance in the above described interface region measured within a wavelength range from 450 nm to 650 nm.

The spectral reflectance means here reflectance (percentage) which is measured with a spectrophotometer (MCPD-2000 manufactured by Otsuka Electronic Co.). Outlining determination of the reflectance, a spectral emission intensity I(O) of a light source of a spectroscope is measured, spectral reflected ray intensity of a photosensitive member I(D) is measured and reflectance R=I(D)/I(O) is calculated. For measuring reflectance with a high accuracy and a high repeatability, it is desirable to fix a detector jig so that the detector jig is set at a definite angle relative to the photosensitive member which has curvature.

A specific example of interface control is shown in FIGS. 1A and 1B. An example A (a value of the above described equation (1): 0.48) and an example B (a value of the above described equation (1): 0.41) shown in FIG. 1A are measuring examples "having interface", whereas an example C (a value of the above described equation (1): 0.28) and an example D (a value of the above described equation (1): 0.16) are measuring examples "having no interface" which satisfies the equation according to the present invention. Two lines indicate a difference produced due to a difference between film thicknesses of surface protective layers, and waveform moves dependently on differences between the film thicknesses rightward and leftward on graphs. Since a maximum value of reflectance corresponds to an amplitude of a waveform, reflectance of the photosensitive member having an interface varies more remarkably dependently on a variation of a film thickness than the photosensitive member having no interface at a fixed wavelength. That is, sensitivity varies remarkably dependently on the variation of a film thickness.

That is, fine roughness produces substantial film thickness ununiformity of a surface protective layer in an optical path of incidence for image exposure. It is considered that this film thickness ununiformity causes a sensitivity variation of the photosensitive member having interface which is larger than that of the photosensitive member having no interface, thereby aggravating fog which forms a core of the toner adhesion or sharpness of the image.

Average Inclination Δa

Now description will be made of the average inclination Δa according to the present invention.

An average inclination Δa measured with a surface roughness meter is defined by a formula shown below which is described in sections 8–12 of chapter 8 "definitions terms and parameters of surface roughness" of an instruction manual for Surface Roughness Meter SE-3300 manufactured by Kosaka Laboratory Co., Ltd. (manufactured in March, 1993).

$$\Delta a = (1/L)\int_0^L |d/dx \cdot f(x)|dx \quad \text{< Equation 1 >}$$

On the other hand, the average inclination Δa within the range of 10 μm×10 μm according to the present invention indicates a value which is calculated from a three dimensional form with the atomic force microscope (AFM) (Q-SCOPE) 250 manufactured by Quesant Co. (version 3.181)).

Two dimensional average inclinations Δa of optional sectional curves which were calculated by the inventor at al. from three dimensional forms measured with the above described atomic force microscope were generally coincident with average inclinations Δa within the range of 10 μm×10 μm which were calculated from three dimensional forms. From viewpoints of a stability of measured values and a correlation with the toner adhesion preventing effect, however, the average inclinations Δa calculated from the three dimensional forms are more preferable.

However, the present invention is not limited by the average inclination Δa within the range of 10 μm×10 μm which are calculated from the three dimensional forms.

Atomic force microscopy which provides a horizontal resolution (resolution in a direction in parallel with a sample surface) higher than 0.5 nm and vertical resolution (resolution in a direction perpendicular to the sample surface) of 0.01 to 0.02 nm, permits measuring a three dimensional form of a sample and is largely different in the high resolution from a surface roughness meter which has conventionally been used widely.

At the resolution which is so high, it is possible to measure roughness not on the order which is governed by roughness of a substrate of a photosensitive member but roughness resulting from natures of deposited films themselves such as a photoconductive layer and a surface layer.

The roughness of the substrate of the photosensitive member is dependent on "types" such as "tooth form" and "treating member" of the above described lathe, ball mill and dimple treating work, whereas the roughness of the deposited films themselves has no "type", but form factors which cannot be expressed by Rz (average roughness along centerline) and Ra (average roughness at ten points) specified by JIS and the inventor et al. considered that the form factors would give a first step to the above described toner adhesion prevention. Specifically, the inventor et al. formed amorphous silicon photosensitive member (total layers including inhibition layers, photoconductive layers, surface layers and interfaces among these layers) in various conditions on electrically conductive substrates having surface roughness Ra not lower than 9 nm within an identical visual field range of (10 $\mu$m×10 $\mu$m), observed fine shapes on surfaces with an atomic force microscope, and calculated and compared average inclinations Δa for examination.

Since significant differences could not observed in similar measurements with a surface roughness meter which has conventionally been used widely, for example, a surface roughness meter (SE-3400) manufactured by Kosaka Laboratory Co., Ltd., it is considered that an index used for the present invention is a new index which represents characteristics of materials of amorphous silicon photosensitive members.

In addition, the inventor et al. measured several samples with several scan sizes with the atomic force microscope. The scan size is a length of a side of a scanned rectangle. A scan size of 10 $\mu$m therefore means a scanned area of 10 $\mu$m×10 $\mu$m, that is, 100 $\mu m^2$. FIG. 2 shows some results obtained by checking a relation between the scan size and the average inclination Δa, the abscissa of the graph representing the scan size.

Measured values are stabilized but fine shapes can hardly be reflected under influences due to special shapes such as undulations, protrusions and the like as well as worked shapes of sample substrates when a scan size is large, that is, when the measuring range is large, and a selection variation of measuring locations is large when a scan size is small, whereby the present invention indicates the average inclinations in the visual field of 10 $\mu$m×10 $\mu$m which is excellent from an overall viewpoint of detecting performance and a stability of measurements.

Therefore, an inventive concept of the present invention is not always limited by the visual field of 10 $\mu$m×10 $\mu$m.

In order to obtain Δa which is preferable for the present invention, it is effective to adjust parameters of manufacturing conditions such as a high-frequency electric power and a frequency of the electric power, a pulse variation of the high-frequency electric power, a gas flow rate, a pressure, a substrate temperature and film thicknesses at stages of forming functional layers such as an inhibition layer, a photoconductive layer and a surface protective layer on a substrate by a high-frequency plasma CVD (PCVD) method. As a requirement for forming a deposited film surface having a large Δa, there can be the case where (1) a precursor of film formation which reaches a grown surface of a deposited film is not diffused sufficiently on the surface, or the precursor reaches in a large amount and a time is insufficient for the precursor to be dispersed on the surface or (2) a film is deposited in a condition where a gas phase polymerization reaction easily occurs and while taking a polymer produced in a gas phase. Specifically, conceivable as the requirement for forming the deposited film surface having the large Δa is to increase the high-frequency electric power, increase the gas flow rate, enhance the pressure, lower the substrate temperature, thicken the film thickness or the like. In such manufacturing conditions, however a quality of a deposited film may be degraded and a sufficient electrophotographic characteristic is not obtained when an a-Si photosensitive member is manufactured, thereby lowering an yield. In order to form an a-Si photosensitive member having a large Δa, it is therefore indispensable to adjust the parameters of the manufacturing conditions carefully so that a quality of a deposited film is not degraded as far as possible.

Though it is preferable that the manufacturing conditions for obtaining the deposited film having the large Δa are adopted for the photoconductive layer which occupies a most portion of a photosensitive member from a viewpoint of an effect of the manufacturing conditions, the conditions for controlling the Δa may be adopted only for the inhibition layer and the surface protective layer which produce little influence on the electrophotographic characteristic.

Furthermore, the average inclination Δa within a range preferable for the present can be obtained also by performing a post-treatment such as abrasion as occasion demands after depositing a film. Needless to say, the abrasion is performed while being appropriately adjusted dependently on a characteristic of the deposited film as well as depositing condition of the film. Using a tape to which fine particles of SiC are adhered (SiC abrading tape), for example, the abrasion can be performed by rubbing a surface of the surface of the photosensitive member on which film is deposited.

Specifically, a method described below can be used for obtaining surface roughness within the range of Δa=0.12 to 1.0 preferable for the present invention.

For example, there is a method which obtains a desired Δa by abrading the surface of the photosensitive member by dry or wet abrasion using as an abradant fine powder of silica, chromium oxide, titanium oxide, iron oxide, zirconium oxide, diamond, nitrogen carbide, silicon carbide, silicon nitride, serium oxide or the like. Furthermore, there is available a method which obtains a desired Δa by buffing, magnetic abrasion, magnetic fluid FFF, FFF utilizing electroemphoresis, FFF utilizing plasma (FFF: Field assisted Fine Finishing), EEH (Elastic Emission Haching) or abrasion with a wrapping film. This method permits reducing Δa when it is larger than a desired value.

FIG. 11 is a diagram descriptive of an apparatus for abrading a surface of a electrophotographic photosensitive member.

Reference numeral 1 denotes an electrophotographic photosensitive drum on a surface of which a surface layer to be treated is disposed. Reference numeral 2 denotes an abrading tape having an abrading surface over which crystalline SiC is coated (trade name: WRAPPING TAPE LT-C2000, manufacturer: Fuji Film). Reference numeral 3 denotes a cylindrical supporting body which brings the abrading tape 2 into contact with the surface of the photosensitive drum 1.

In addition to the tape having the abrading surface over which the crystalline SiC is coated, usable as abrading tapes preferable for the present invention is a tape over which powder of iron oxide, alumina, diamond or the like is coated. Reference numeral 4 denotes a cradle for the cylindrical supporting body 3 which is disposed in parallel with a rotating shaft of the photosensitive drum 1 and is loaded with a weight 5. Reference numeral 6 denotes a feeding motor which feeds out the abrading tape 2, thereby being sent at the definite speed while being pulled by a weight 7.

Since the abrading tape is sent in a forward direction of a rotation of the photosensitive member at this stage, the surface layer is abraded without accumulating abraded power of SiC or a foreign matter in a gap between the abrading tape 2 and the photosensitive drum 1, and a desired Δa can be obtained. This method permits reducing a Δa when it has a value larger than desired. FIG. 12 is a sectional view of the abrading apparatus taken along a 12—12 line in FIG. 11. The photosensitive drum 1 is movable in a direction of a rotating shaft (X direction). Alternately, the abrading tape 2 or the cylindrical supporting body 3 may be moved. Accordingly, the abrading apparatus is capable of performing two-dimensional abrasion control and permits easily obtaining a desired Δa.

BRIEF DESCRIPTION OF THE DRAWINGS

The file of this patent contains at least one drawing executed in color. Copies of this patent with color drawings will be provided by the Patent and Trademark Office upon request and payment of the necessary fee.

PREFERRED EMBODIMENTS OF THE INVENTION

Now, the present invention will be described in detail referring to the accompanying drawings as occasion demands.

a-Si Photosensitive Member According to the Present Invention

Figure 1A:
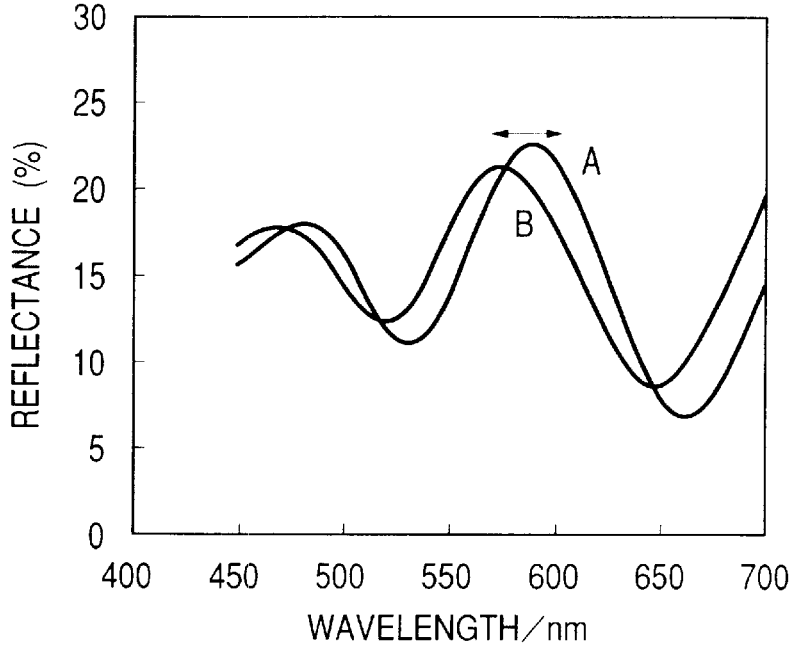
FIGS. 1A and 1B are diagrams descriptive of an example of interface reflection control of a surface protective layer.
Figure 1B:
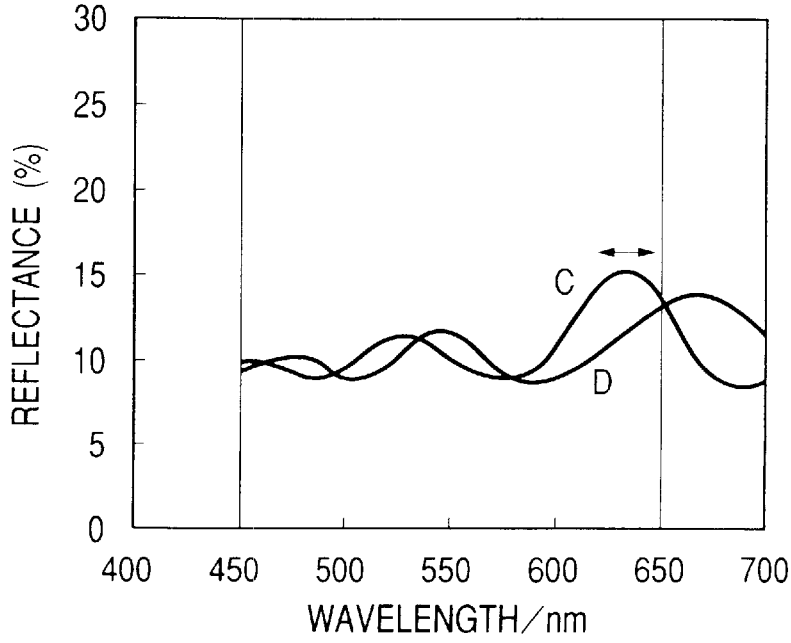
Figure 2:
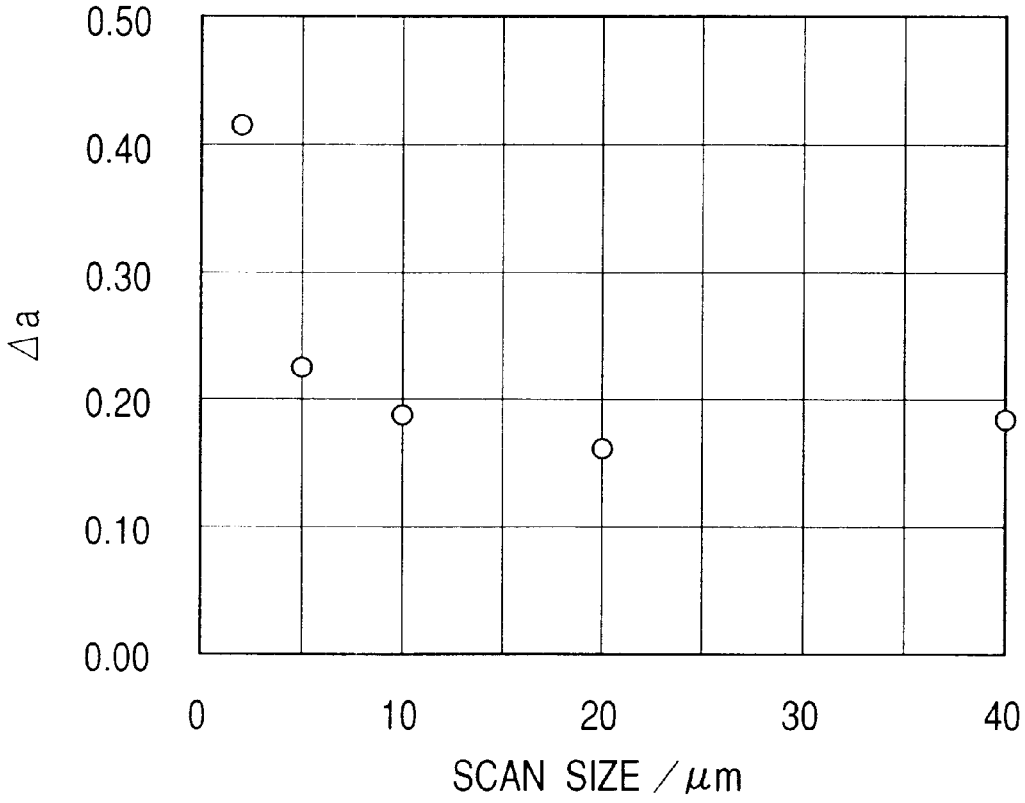
FIG. 2 is a diagram descriptive of an example of measuring range for an AFM.
Figure 3A:
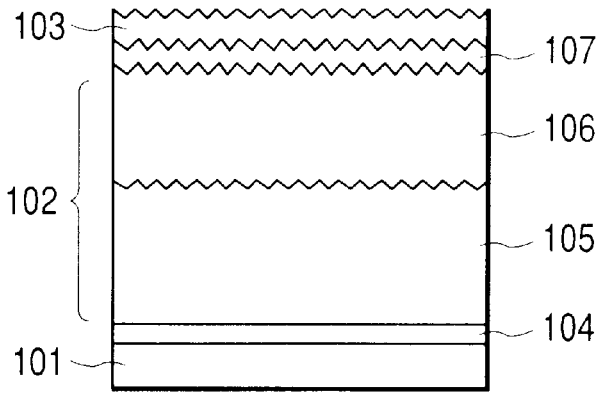
FIGS. 3A, 3B and 3C are schematic sectional views descriptive of an example of electrophotographic photosensitive member.
Figure 3B:
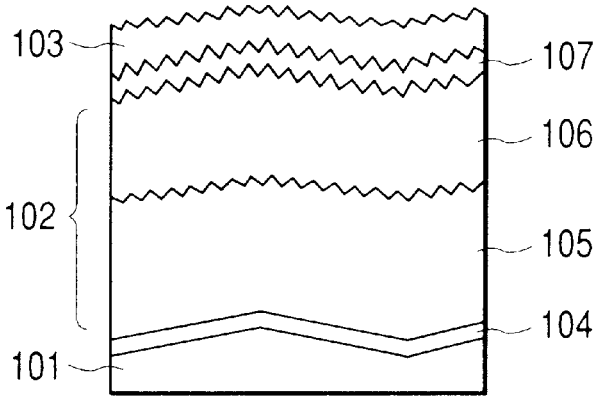
Figure 3C:
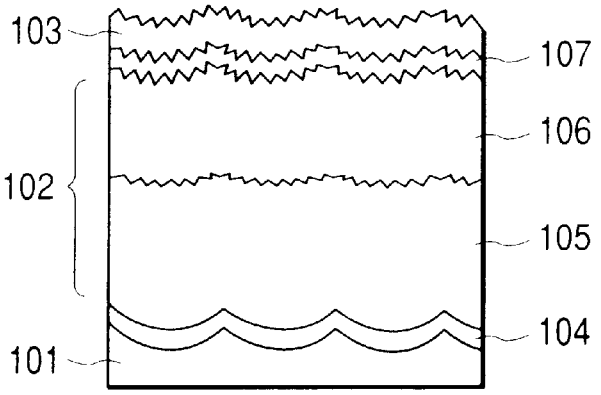

FIGS. 3A through 3C are diagrams showing partial sections of an electrophotographic photosensitive member according to the present invention. Shown in these drawings is an example having functional layers such as a photoconductive layer and a surface layer laminated on a substrate.

Mentionable as the example of the electrophotographic photosensitive member according to the present invention is a photosensitive member having a photosensitive layer 102 and a surface protective layer 103 laminated consecutively on a substrate 101 as shown in FIGS. 3A through 3C which is made of an electrically conductive material such as Al or stainless steel, or a transparent substrate such as glass, plastic having a surface to which electric conductivity is imparted. In addition to these layers, various kinds of functional layers such as a inhibition layer 104 and a reflection prevention layer or an interface layer 107 may needlessly be disposed as occasion demands. It is possible to control a charging polarity such as positive charging or negative charging, for example, by disposing the inhibition layer 104 and the interface layer 107, and selecting elements of III group or V group as dopants for these layers. A form of the substrate may be optional dependently on a driving system for the electrophotographic photosensitive member. Though a material of the substrate is generally a electrically conductive material such as the above described Al or stainless steel, usable as materials of the substrate are, for example, various kinds of plastic and ceramic materials which have no electrical conductivity in particular but to which electrical conductivity is imparted by depositing these electrically conductive materials.

Though an organic or inorganic material is usable as the photoconductive layer 102 so far as the material has photoconductivity, it is desirable to use, for example, an inorganic photoconductive material which has a main body of an amorphous material in which a silicon atom contains a hydrogen atom and a halogen atom (hereinafter abbreviated as "a-Si (H, X)"). Alternately, it is possible to appropriately combine inorganic materials such as a-Se. Though a thickness of the photoconductive layer 102 is not limited in particular, it is appropriate to select a thickness on the order of 15 μm to 50 μm taking a manufacturing cost into consideration.

Furthermore, it is possible to configure the electrophotographic photosensitive member so as to have a plurality of layers of a lower photoconductive layer 105 and an upper photoconductive layer 106 in order to enhance a characteristic. Such a contrivance of a layer configuration provides an epoch-making effect for a light source such as a semiconductor laser emitting rays which have a relatively long wavelength scarcely variable in particular.

The surface protective layer 103 is made of a non-single crystalline (preferably amorphous) material (a-SiC (H, X) which generally contains silicon as a parent body, carbon atom, and hydrogen atom or halogen atom as occasion demands, a non-single crystalline (preferably amorphous) material (a-SiN (H, X) which contains silicon atom as a parent body, nitrogen atom and hydrogen atom or halogen atom as occasion demands, a non-crystalline carbon (preferably amorphous) (a-C (H, X)) which contains carbon atom as a parent body and hydrogen atom or halogen atom as occasion demands, or the like. Furthermore, it is preferable to dispose an interface layer 107 having a continuously varying composition between the photoconductive layer 102 and the surface protective layer 103 and control the above describe interface layer 107 so as to reduce reflection on an interface. Furthermore, a surface of the substrate 101 shown in FIGS. 3B and 3C has concave and convex grooves formed by cutting or a dimple shape. Such a surface shape is capable of enclosing interference fringes which are produced by reflection of exposing rays reaching the surface of the substrate 101, for example, within fine regions which cannot be observed by eyes. Needless to say, it can be expected that the surface shape enhances an adhesion property between the substrate 101 and a film formed on the substrate 101.

Film Forming Apparatus for a-Si Photosensitive Member According to the Present Invention An example of a film forming apparatus for a-Si photosensitive member according to the present invention will be explained.

Figure 4:
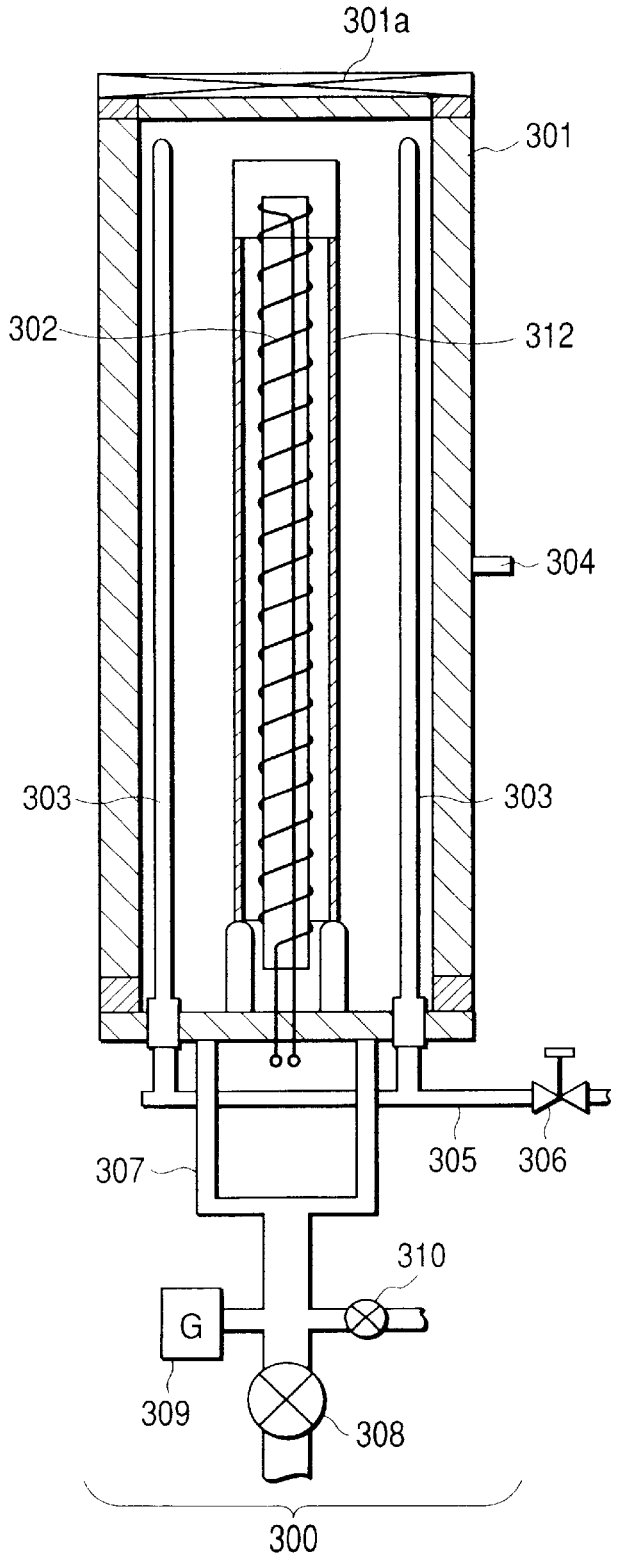
FIG. 4 is a schematic sectional view descriptive of film forming apparatus which is usable for forming an a-Si photosensitive member according to the present invention.

The photosensitive member according to the present invention is configured as an a-Si photosensitive member on which an a-Si photosensitive layer is formed by a high frequency plasma CVD (PCVD) method. An example of PCVD apparatus usable for the present invention is shown in FIG. 4. The apparatus shown in FIG. 4 is a general PCVD apparatus used for manufacturing electrophotographic photosensitive members. This PCVD apparatus is configured to have a depositing apparatus 300, a raw material gas supplying apparatus and an exhausting apparatus (both not shown). The depositing apparatus 300 has a reaction container 301 consisting of a vertical type vacuum container, a plurality of raw material gas inlet pipes 303 which are disposed in a longitudinal direction in the reaction container 301 and a large number of thin slots formed in side surfaces of the gas inlet pipes 303 in a longitudinal direction. A heater 302 spirally wound with a wire is disposed at a center in the reaction container 301 so as to extend in a vertical direction, and a cylindrical body 312 which is a substrate of a photosensitive drum is inserted with a top cover of the container 301*a* kept open and installed vertically in the container 301 so that the heater 302 is located inside. Furthermore, high-frequency electric power is supplied from a convex portion 304 disposed on a side surface of the reaction container 301.

Attached to a bottom surface of the reaction container 301 is a raw material gas supply pipe 305, which is connected to a raw material gas supply pipe 303, and the supply pipe 305 is connected to a gas supply apparatus (not shown) by way of a supply valve 306. Furthermore, attached to the bottom surface of the reaction container 301 is an exhaust pipe 307 which is connected to an exhaust apparatus (vacuum pump) by way of a main exhaust pump 308. In addition, attached to the exhaust pipe 307 are a vacuum gauge 309 and a sub-exhaust valve 310.

Using the above described apparatus, the a-Si photosensitive layer is formed by the PCVD method as described below. First, after the cylindrical body 312 is set in the reaction container 301 as the substrate of the photosensitive member and the cover 301*a* is closed, the container 301 is evacuated with an exhaust system (not shown) until an interior of the container 301 is set at a pressure not higher than a predetermined low pressure, the substrate 312 is heated from inside with the heater 302 while continuing evacuation and the substrate 312 is controlled to a desired temperature within a range of 20° C. to 450° C. When the substrate 312 is maintained at a predetermined temperature, desired raw material gases are introduced into the reaction container 301 through the inlet pipe 303 while controlling with flow controllers (not shown) for the raw material gases respectively. The introduced raw material gases fill the reaction container 301 and then are exhausted outside the container 301 through the exhaust pipe 307.

When the vacuum gauge 309 allows confirmation that the interior of the reaction container 301 filled with the raw material gases has been stabilized at the predetermined pressure, the high-frequency electric power is supplied in a desired quantity from a high-frequency power source (having an RF band at 13.56 MHz, a VHF band at 50 to 150 MHz or the like) (not shown) to the container 301, thereby causing glow discharge in the container 301. Owing to an energy of this glow discharge, components of the raw material gases are decomposed and plasma ions are produced, thereby forming a deposited layer of a-Si containing silicon as a main body on a surface of the substrate 312. It is possible to form deposited layers of a-Si which have various characteristics by adjusting parameters such as kinds, amounts to be introduced, introduction ratios and pressures of the gases, as well as a substrate temperature, electric power to be supplied and a film thickness. Accordingly, electrophotographic characteristics can be controlled.

When the a-Si layer has been deposited to a desired thickness on the surface of the substrate 312 as described above, the supply of the high-frequency power is stopped, the supply valve 306 and the like are closed and the introduction of the taw material gases into the reaction container 301 is stopped, thereby terminating the deposition of one layer of a-Si. An a-Si deposited layer having a desired multi-layer configuration, that is, an a-Si photosensitive layer is formed by repeating similar operations several times while appropriately changing conditions and gases to be used, whereby a photosensitive drum having the a-Si photosensitive layer having the multi-layer configuration on the surface of the substrate 312 is manufactured.

Furthermore, the reduction and control of the refection on the interface of between the surface protective layer and the photoconductive layer according to the present invention is achieved by continuously changing an electric power condition and a gas composition without stopping the supply of the high-frequency electric power and the supply of the raw material gases at a step of terminating the deposition of the a-Si layer. Alternately, the reduction and the control can be achieved by once stopping the high-frequency electric power but by supplying the raw material gases so as to start film deposition from a configuration of a preceding layer while continuously changing the composition of the raw material gases to a desired one.

During the layer deposition described above, it is possible to control an electrophotographic of the a-Si deposited film on the substrate 312 in a longitudinal direction of the gas inlet pipes 303 by adjusting a flow rate distribution of the raw material gases introduced into the reaction container 301 from the narrow slots distributed in the longitudinal direction of the gas inlet pipes 303, a speed of a waste gas flowing out of the exhaust pipe, a discharge energy and the like.

Electrophotographic Apparatus According to the Present Invention

Figure 5:
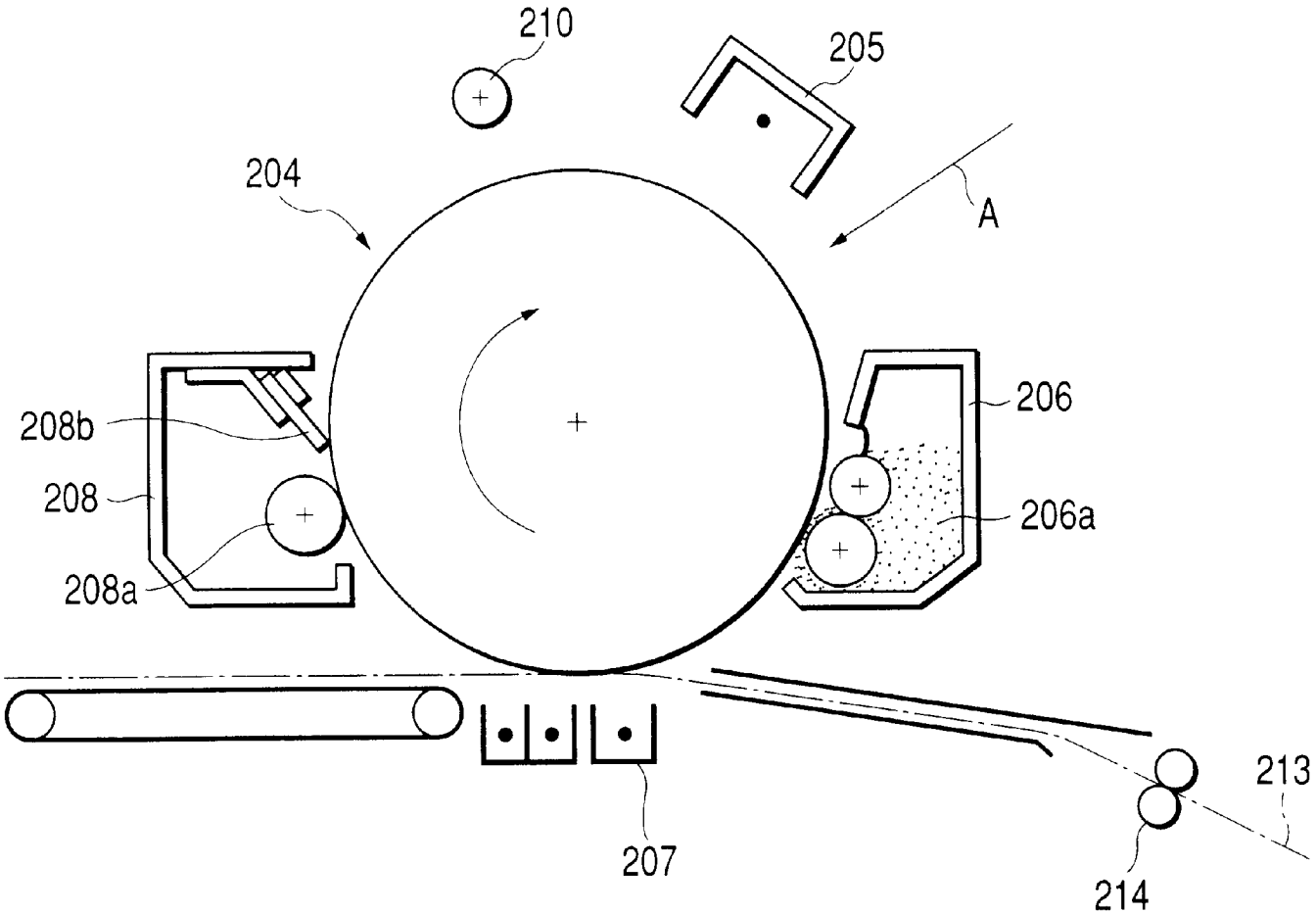
FIG. 5 is a schematic sectional view descriptive of a preferable example of electrophotographic apparatus.

FIG. 5 shows an example of an electrophotographic apparatus which uses the electrophotographic photosensitive member manufactured as described above. Though the apparatus taken as the example is preferable for use with a cylindrical electrophotographic photosensitive member, the electrophotographic apparatus according to the present invention is not limited by the example and the electrophotographic apparatus is applicable to a photosensitive member which has a form of an endless belt or an optional form.

In FIG. 5, disposed around a member which is referred to as an electrophotographic photosensitive member 204 in the present invention are a primary charger 205 which performs charging for forming an electrostatic latent image on the photosensitive member 204, a developing apparatus 206 for supplying a developer (toner) to the photosensitive member 204 on which the electrostatic latent image is formed, a transferring charger 207 for transferring the toner from a surface of the photosensitive member to a transferring material 213 such as paper and a cleaner 208 for cleaning the surface of the photosensitive member. Though an elastic roller 208*a* and a cleaning blade 208*b* are used for cleaning the surface of the photosensitive member uniformly and effectively in this example, only either of these members may be used. Furthermore, disposed between the cleaner 208 and the primary charger 205 is a charge removing lamp 210 for removing charges from the surface of the photosensitive member as a preparation for a next copying operation, and the transferring material 213 is fed by a feeding roller 214. Used as a light source for exposure A is a halogen light source or a light source which emits mainly rays which have a wavelength.

Using the apparatus described above, a copied image is formed, for example, as described below.

First, the electrophotographic photosensitive member 204 is rotated at a predetermined speed in a direction indicated by an arrow and the surface of the photosensitive member 204 is uniformly charged by the primary charger 205. Then, the exposure A of an image is performed on the charged surface of the photosensitive member 204 to form an electrostatic latent image on the surface of the photosensitive member 204.

At a stage where a portion of the surface of the photosensitive member 204 on which the electrostatic latent image is formed passes by a location at which the developing apparatus 206 is disposed, the toner is supplied to the surface of the photosensitive member 204 by the developing apparatus 206, the electrostatic latent image is visualized (developed) by the toner 206*a* as a toner image, the toner image reaches a location at which the transferring charger 207 is disposed as the photosensitive member 204 rotates and transferred to the transferring material 213 which is fed by the feeding roller 214.

After completing transferring, residual toner is removed from the surface of the electrophotographic photosensitive member 204 by the cleaner 208 as a preparation for a next copying step and charges are eliminated with a charge removing device 209 and the charge removing lamp 210 until a potential on the above described surface is zeroed or nearly zeroed, thereby terminating a copying step.

Figure 6:
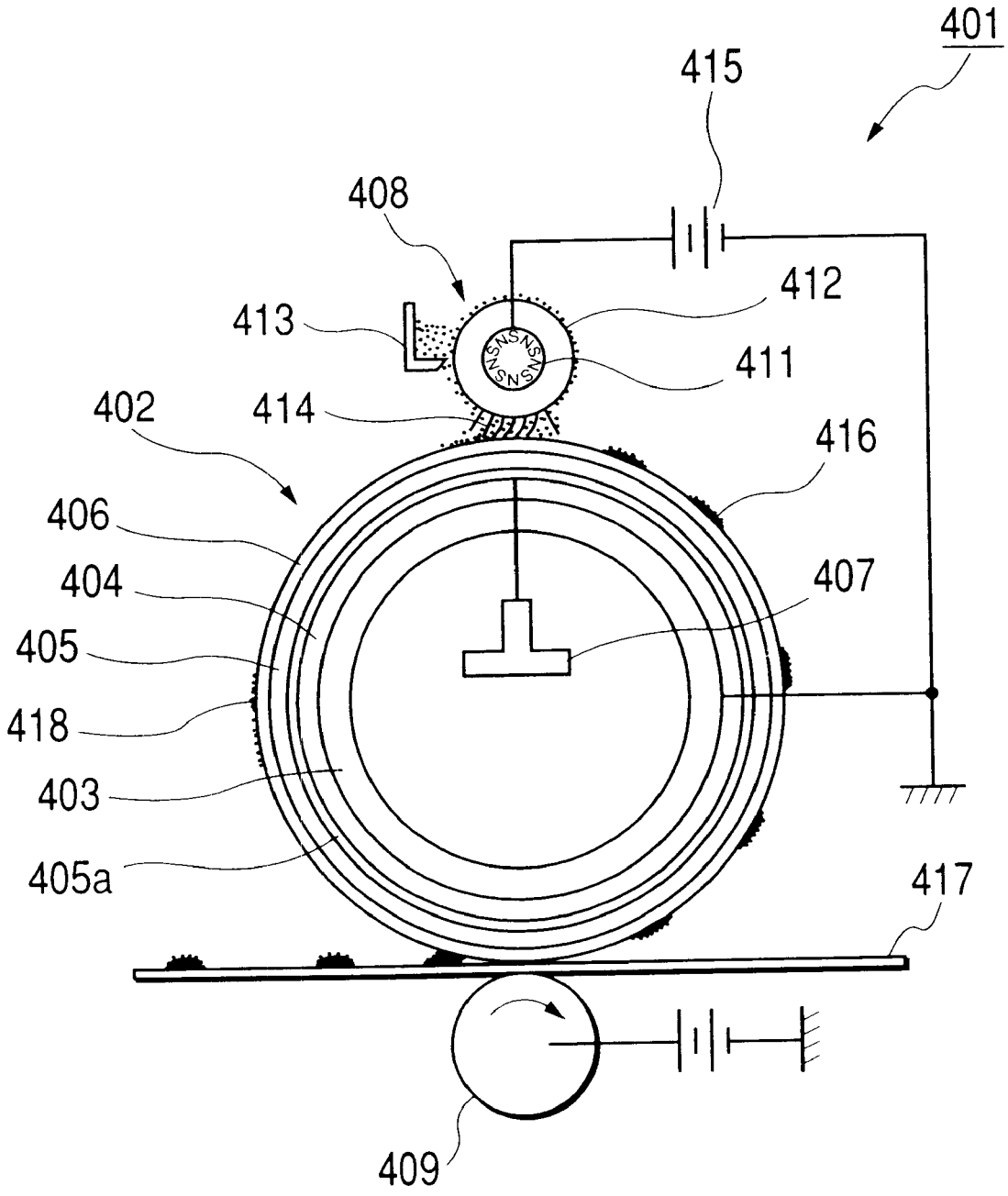
FIG. 6 is a schematic sectional view descriptive of another preferable example of electrophotographic apparatus.

FIG. 6 is a schematic diagram showing the electrophotographic apparatus according to the present invention in which a cleaning apparatus is omitted. An electrophotographic apparatus 401 shown in FIG. 6 comprises a drum like photosensitive member 402 which has a light transmitting electrically conductive layer 404, a insulating carrier injection inhibition layer 405*a,* a photoconductive layer 405 and a surface layer 406 laminated on a light transmitting substrate 403, an LED head 407 which functions as exposure means, a developing apparatus 408 and a transferring roller 409. The LED head 407 and the developing apparatus 408 are disposed nearly symmetrically with regard to a certain portion of the photosensitive member 402.

The developing apparatus 408 consists, for example, of a cylindrical magnetic roller 411 which has eight poles, and an electrically conductive sleeve 412 disposed along an outer circumference of the magnetic roller, and a single-component magnetic electrically conductive toner which is stored in a toner receiver 413 as a developer is delivered to an outer circumference of the sleeve 412 to form a magnetic brush 414. A bias power supply 415 is disposed between the sleeve 412 and the light transmitting electrically conductive layer 404, and a positive or negative voltage of 0 to 300 V is applied across the layer 404 and the power supply 415 dependently on a potential characteristic of the photosensitive member 402. A toner layer 416 is formed on the surface of the photosensitive member 402 and brought into contact with recording paper 417. Reference numeral 418 denotes the toner remaining on the surface of the photosensitive member after the toner layer 416 is brought into contact with the recording paper 417. In addition, there are disposed rotating means for the developer and rotating means for the photosensitive member 402.

Exposure is performed from a side of a light transmitting supporting body with an exposing device and the surface of the photosensitive member is rubbed with a magnetic brush composed of the electrically conductive magnetic toner on the developing apparatus to which a bias voltage is applied by a power supply for supplying developing bias, whereby charging and development are performed nearly simultaneously, and a toner image is formed on the photosensitive member. The toner image is transferred using the transferring roller and fixed by fixing means into recorded image. On the other hand, a cleaning device is omitted since the toner remaining on the photosensitive member is recovered by the developing apparatus and used once again. The electrophotographic apparatus according to the present invention is capable of removing unnecessary toner adhering to the surface of the photosensitive member 402 extremely securely owing surface conditions such as an average inclination of the surface of the photosensitive member, thereby not only preventing an image quality from being degraded and maintaining image sharpness for a long time.

Figure 13:
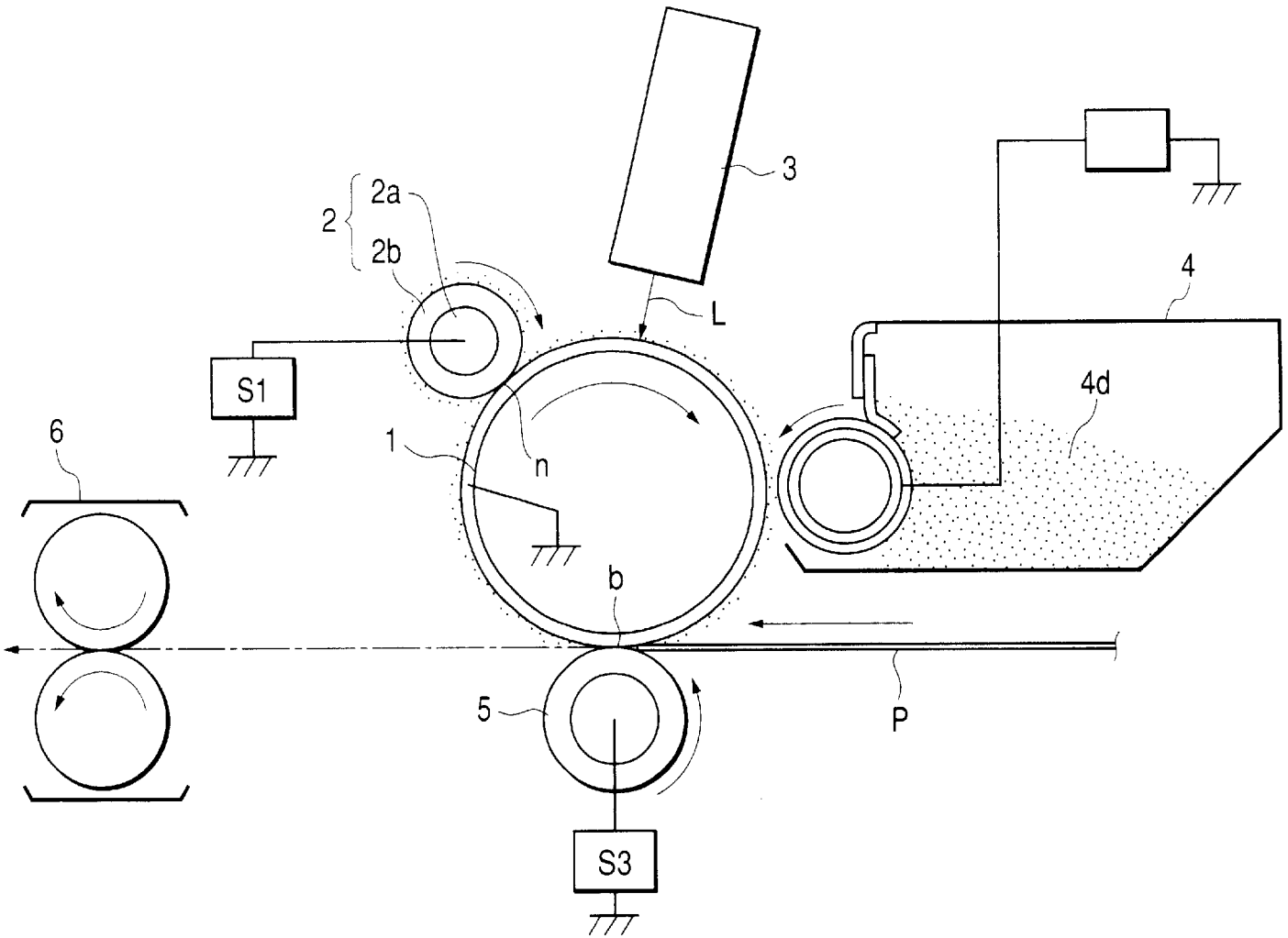
FIG. 13 is a diagram descriptive of a laser printer using a toner recycle process (cleanerless system).

FIG. 13 shows a laser printer (recording apparatus) which uses a toner recycle process (cleanerless system).

Reference numeral 1 denotes a photosensitive member functioning as an image bearing body which is rotatingly driven at a peripheral speed in a clockwise direction indicated by an arrow. Reference numeral 2 denotes an electrically conductive elastic roller (hereinafter referred to as a charging roller) functioning as a contact charging member. This charging roller 2 is composed by forming a medium resistance layer 2*b* of rubber or foaming material on a core metal 2*a* as a flexible member. It is desirable that the medium resistance layer 2*b* is formulated with resin (for example, urethane), electrically conductive particles (for example, carbon black), a sulfurizing agent, an expanding agent or the like, composed in a form of a roller on the core metal 2*a* and has resistance of $1\times10^4$ to $1\times10^7\Omega$.

Furthermore, a DC voltage is applied as a charging bias voltage to the core metal 2*a* of the charging roller 2 from a charging bias voltage applying power supply S1. Reference numeral 3 denotes a laser beam scanner (exposing device) which comprises a laser diode, a polygonal mirror and the like. This laser beam scanner outputs a laser beam which has an intensity modulated correspondingly to a time series electric digital pixel signal of target image information for scanning exposure of a uniformly charged surface of the above described rotating photosensitive member 1 with the above described laser beam. By this scanning exposure L, an electrostatic latent image corresponding to the target image information is formed on the surface of the rotating photosensitive member 1.

Reference numeral 4 denotes a developing apparatus. The electrostatic latent image on the surface of the rotating photosensitive member 1 is developed into a toner image by this developing apparatus. In this example, the developing apparatus is a reversal developing apparatus which uses a magnetic single-component insulating toner (negative toner).

A developer 4*d* is a mixture of a toner t and charging acceleration particles (charging aid particles) m, and the toner t is prepared by mixing integrity resin, particles of a magnetic substance and a charge control agent, kneading, grinding and classifying the mixture, and adding the charging acceleration particles m and a fluidization agent to the mixture as external additives. The toner t has a weight-average particle diameter of 7 μm. In this example, electrically conductive zinc oxide particles having a particle diameter of 3 μm are used as the charging acceleration particles m. Furthermore, 2 wight parts of the charging acceleration particles m are externally added to 100 weight parts of the toner t in this example.

Though electrically conductive zinc oxide particles which has specific resistance of $1\times10^6$ Ω.cm and an average particle size of 3 μm including that of a secondary aggregate as the charging acceleration particles m having electrical conductivity in this example, usable as materials of the charging acceleration particles m are various kinds of electrically conductive inorganic particles of other metal oxides, mixtures of those particles and organic substances, and the like.

Reference numeral 5 denotes a transferring roller which functions as contact transferring means and is kept in pressure contact with the photosensitive member 1 so as to form a transferring nip portion b. When a transferring material P is fed as a recording medium to the transferring nip portion b at a predetermined timing from a sheet feed section (not shown) and a predetermined transferring bias voltage is applied to the transferring roller 5 from a transferring bias voltage power supply S3, the toner image is transferred consecutively from the photosensitive member 1 to a surface of the transferring material P fed to the transferring nip portion b.

Reference numeral 6 denotes a heat fixing type fixing apparatus. The transferring material P which is fed to the transferring nip portion b and to which the toner image is transferred from the photosensitive member 1 side is separated from the surface of the photosensitive member 1, introduced into the fixing apparatus 6, subjected to fixing of the toner image and discharged as an article having an image (print or copy) outside the laser printer.

In the cleanerless type laser printer in this example, the toner which remains on the surface of the photosensitive member 1 after transferring the toner image is not removed by the cleaner and reaches a developing portion through a charging portion n as the photosensitive member 1 rotates and is cleaned (recovered) simultaneous with developing (toner recycle process) in a developing apparatus 4.

Furthermore, in an embodiment the of the image forming apparatus of the present invention, the charging acceleration particles that adhere to the surface of the photosensitive member in a developing portion remain on the surface of the photosensitive member even after transferring, and the charging acceleration particles are brought and interposed at least into a nip portion between the contact charging roller of the charging means and the photosensitive member.

Now, the present invention will be described in detail on the basis of various experimental examples.

Experimental Example 1

While modifying a forms of a substrate and the parameters of the manufacturing conditions with the above described a-Si photosensitive member film forming apparatus, there were manufactured electrophotographic photosensitive members Nos. 101 through 113 which had different average inclinations Δa at a measuring level of an AFM and different average inclinations Δa at a measuring level of a surface roughness meter. Cylindrical substrates made of Al which were used as electrically conductive substrates were subjected to various substrate surface works such as cutting work and dimple work.

Table 1 lists average inclinations Δa of the photosensitive members Nos. 101 through 113 which were measured within a range of 10 μm×10 μm with the AFM, average inclinations Δa which were measured with the contact type surface roughness meter and results of image evaluation.

In the present invention, the average inclinations Δa at the measuring level of the surface roughness meter are values of average inclinations Δa which are measured for an evaluation length of 1.25 mm with a contact type surface roughness meter "SURF CODER SE-3400 manufactured by Kosaka Laboratory Co., Ltd."

In addition, the inventor et al. measured average inclinations Δa for several evaluation lengths for several samples with the above described surface roughness meter. A portion of results is shown in FIG. 7.

Figure 7:
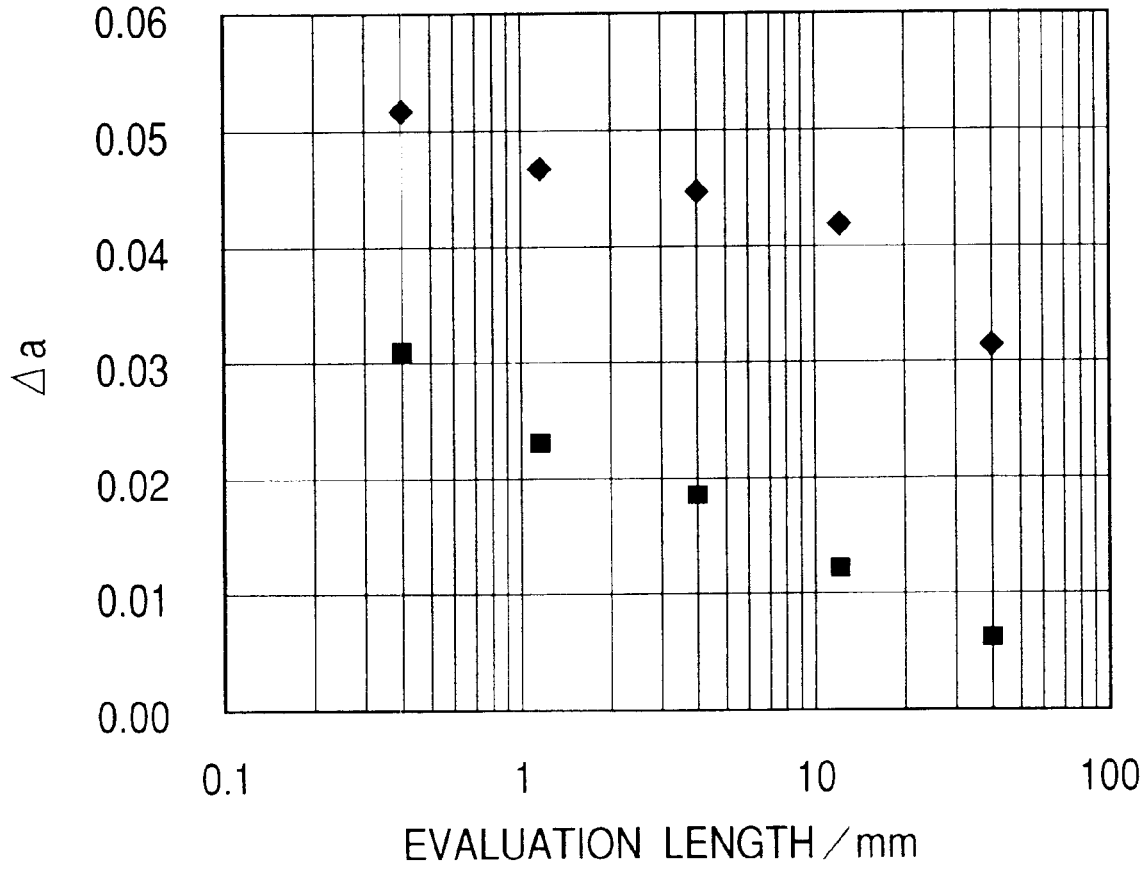
FIG. 7 is a diagram descriptive of lengths evaluated with a surface roughness meter.

FIG. 7 shows a relation between evaluation lengths and average inclinations Δa at the measuring level of the surface roughness meter for two samples which were manufactured using different substrates and in different film forming conditions, and had relatively low roughness and medium roughness.

Since the evaluation lengths correlate with Δa, that is, since roughness cannot be expressed accurately unless an evaluation length is specified, average inclinations Δa measured for the evaluation length of 1.25 mm are listed in the present invention.

For evaluating images, 500,000 sheets were passed for a durability test with a test pattern at a print ratio of 3%, which is lower than usual, using Electrophotographic Apparatus NP6350 manufactured by Canon, and a solid white image and a solid black image were output periodically for evaluating toner adhesion.

Symbols in Table 1 are A: excellent, B: not problematic for practical use and C: may be problematic for practical use.

From the results listed in Table 1, no correlation was found between values of Δa at the measuring level of the surface roughness meter and toner adhesion. In contrast, a correlation was found between values of average inclination Δa at the measuring level of the AFM and toner adhesion.

Furthermore, values of average inclination Δa at the measuring level of the AFM and values of average inclination Δa at the measuring level of the surface roughness meter were different even for an identical photosensitive member, and no correlation was found between values at these two levels. It is considered that this difference results from that the AFM measures average inclination Δa of fine roughness of the a-Si film itself, whereas the surface roughness meter measures average inclination Δa dependent on a form of a substrate.

TABLE 1

| | Average inclination Δa at AFM level | Average inclination Δa at surface roughness meter | Image evaluation Toner adhesion |
|---|---|---|---|
| 101 | 0.36 | 0.019 | A |
| 102 | 0.25 | 0.017 | A |
| 103 | 0.11 | 0.011 | C |
| 104 | 0.14 | 0.012 | B |
| 105 | 0.11 | 0.038 | C |
| 106 | 0.13 | 0.061 | A |
| 107 | 0.18 | 0.073 | A |
| 108 | 0.12 | 0.045 | B |
| 109 | 0.98 | 0.030 | A |
| 110 | 0.89 | 0.024 | A |

TABLE 1-continued

| | Average inclination Δa at AFM level | Average inclination Δa at surface roughness meter | Image evaluation Toner adhesion |
|---|---|---|---|
| 111 | 0.76 | 0.078 | A |
| 112 | 0.15 | 0.086 | B |
| 113 | 0.10 | 0.033 | C |
| Evaluating apparatus | AFM manufactured by Quesant | Surface roughness meter manufactured by Kosaka Laboratory Co., Ltd. | Evaluated with NP6350 manufactured by Canon |

Experimental Example 2

Then, electrophotographic photosensitive members Nos. 201 through 212 which had different average inclinations Δa at the measuring level of the AFM and the measuring level of the surface roughness meter and similar photosensitive members Nos. 213 and 214 except that they have no interface were manufactured while modifying the parameters of the manufacturing conditions with the above described a-Si photosensitive member film forming apparatus. Cylindrical substrates made of Al having a purity of 99.9% or higher were used as electrically conductive substrates, which were cut for planished work until microscopic surface roughness Ra was unified not higher than 9 nm.

Table 2 lists average inclinations Δa of the photosensitive members Nos. 201 through 214 which were measured within a range of 10 μm×10 μm with the AFM, average inclinations Δa which were measured with the contact type surface roughness meter, values of reflection on interface according to equation (1) which was measured with a spectrophotometer and results of image evaluation.

For the image evaluation, toner adhesion, improper cleaning and sharpness of digital images were evaluated by passing 500,000 sheets for durability test with a test pattern at a print ratio of 3%, which is lower than usual, using Electrophotographic Apparatus NP6350 with no modification, NP6350 having an image exposure system modified for irradiation with an LED array and NP6350 having an image exposure system modified for irradiation with a laser.

The toner adhesion and the improper cleaning were evaluated by checking repeatabilities while outputting a solid white image and a solid black image periodically, whereas sharpness of digital images was evaluated by checking repeatabilities while forming patterns at a line width of 60 μm to 500 μm and within a range of intervals 60 μm to 500 μm.

Symbols in Table 2 are A: excellent, B: not problematic for practical use and C: may be problematic for practical use.

As seen from the results shown in Table 2, photosensitive members which had average inclinations Δa within a range of 0.12 to 1.0 within the range of 10 μm×10 μm were satisfactory from viewpoints of the toner adhesion, the improper cleaning and the sharpness of the digital images.

Furthermore, photosensitive members which had average inclinations Δa within a range of 0.15 to 0.8 were extremely satisfactory from the viewpoints of the toner adhesion, the improper cleaning and the sharpness of the digital images. Furthermore, the a-Si photosensitive member film forming apparatus which had no interface broadened a region of toner adhesion or sharpness of the images.

TABLE 2

| | Average inclination Δa at AFM level | Average inclination Δa at surface roughness meter level | Value of reflection on interface according to equation (1) | Image evaluation Toner adhesion | Improper cleaning | Sharpness of digital image |
|---|---|---|---|---|---|---|
| 201 | 0.09 | 0.013 | 0.48 | C | A | A |
| 202 | 0.11 | 0.011 | 0.41 | C | A | A |
| 203 | 0.12 | 0.015 | 0.45 | B | A | A |
| 204 | 0.14 | 0.012 | 0.46 | B | A | A |
| 205 | 0.15 | 0.014 | 0.50 | A | A | A |
| 206 | 0.19 | 0.013 | 0.49 | A | A | A |
| 207 | 0.26 | 0.016 | 0.42 | A | A | A |
| 208 | 0.65 | 0.018 | 0.43 | A | A | A |
| 209 | 0.79 | 0.019 | 0.45 | A | A | A |
| 210 | 0.98 | 0.015 | 0.47 | A | B | B |
| 211 | 1.02 | 0.018 | 0.42 | A | B | C |
| 212 | 1.10 | 0.017 | 0.44 | A | C | C |
| 213 | 0.12 | 0.015 | 0.28 | A | A | A |
| 214 | 0.98 | 0.015 | 0.38 | A | A | A |
| Evaluating apparatus | AFM manufactured by Quesant Co. | Contact type surface roughness meter manufactured by Kosaka Laboratory Co., ltd. | MCPD-2000 manufactured by Otsuka Electronics Co. | Evaluated with modified NP6350 manufactured by Canon | | Evaluated with digital modified NP6350 |

Experimental Example 3

Then, electrophotographic photosensitive members Nos. 301 through 306 were manufactured using electrically conductive substrates which had different microscopic surface roughness Ra as measured in the range of 10 μm×10 μm with the AFM. Cylindrical substrates made of Al having a purity not lower than 99.9% were used as the electrically conductive substrates and film forming conditions were adjusted so that average inclinations as measured with the AFM were approximately 0.15 to 0.30.

Table 3 lists microscopic surface roughness Ra of the electrically conductive substrates of the photosensitive members Nos. 301 through 306 and image evaluation results.

As image evaluation, 500,000 sheets were passed for testing durability with a test pattern at a print ratio of 7% using Electrophotographic Apparatus NP6350 manufactured by Cannon and images were evaluated for improper spots. Referred to as improper spots are abnormal partial growth of a film during formation of a photosensitive layer which rarely produces black spots and white spots on printed images.

In Table 3, symbols are A: excellent, B: not problematic for practical use and C: may be problematic for practical use.

As seen from the results shown in Table 3, photosensitive members which had microscopic surface roughness Ra of the electrically conductive substrates below 9 nm, preferably below 6 nm, were free from the improper spots and provided extremely favorable images.

TABLE 3

| | Microscopic surface roughness Ra of substrate | Image evaluation Improper spots |
|---|---|---|
| 301 | 3.1 | A |
| 302 | 5.9 | A |
| 303 | 6.4 | B |
| 304 | 8.5 | B |
| 305 | 12.3 | C |
| 306 | 18.9 | C |
| Evaluating apparatus | AFM manufactured by Quesant Co. | Modified NP6350 manufactured by Canon |

Experimental Example 4

Then, there were manufactured electrophotographic photosensitive members Nos. 401 through 406 each of which had a single photoconductive layer having and which had different average inclinations Δa at the AFM measuring level while modifying the parameters of manufacturing conditions using the above described a-Si photosensitive member film forming apparatus, photosensitive members Nos. 407 through 412 each of which had the above described photoconductive layer in a plurality, and similar photoconductive bodies Nos. 413 and 414 each of which had said photoconductive layer in a plurality and no interface. Cylindrical substrates made of Al having a purity of 99.9% or higher were used as electrically conductive substrates, which were cut for planishing so that microscopic surface roughness Ra was unified below 6 nm.

Table 4 lists average inclinations Δa of the photosensitive members Nos. 401 through 414 which were measured within the range of 10 μm×10 μm with the AFM, average inclinations Δa which were measured with the contact type surface roughness meter and results of image evaluation.

As the image evaluation, 500,000 sheets were passed for testing durability with a test pattern at a print ratio of 3% , which is lower than usual, using Electrophotographic Apparatus NP6350 manufactured by Canon, NP6350 modified for image exposure with an LED array and NP 6350 modified for irradiation with a laser, and toner adhesion, improper cleaning and sharpness of digital images were evaluated.

The toner adhesion and the improper cleaning were evaluated by checking repeatabilities while periodically outputting a solid white image and a solid black image, whereas the sharpness of the digital images was evaluated by checking repeatabilities while forming patterns at line widths of 60 μm to 500 μm and within a range of intervals of 60 μm to 500 μm.

In Table 4, symbols are A: excellent, B: Not problematic for practical use and C: may be problematic for practical use.

As seen from the results shown in Table 4, photosensitive members which had average inclinations Δa of 0.12 to 1.0 within the range of 10 μm×10 μm, preferably within a range of 0.15 to 0.8 were favorable in all of the toner adhesion, the improper cleaning and the sharpness of the digital images.

Furthermore, photosensitive members each of which had the plurality of photoconductive layers and average inclination Δa within a range of 0.12 to 1.0 were extremely favorable in all the toner adhesion, the improper cleaning and the sharpness of the digital images.

Furthermore, omission of an interface broadened a region of the toner adhesion or the sharpness of the images.

TABLE 4

| | Average inclination Δa | Average inclination Δa at surface roughness meter level | Image evaluation | | |
|---|---|---|---|---|---|
| | | | Toner adhesion | Improper cleaning | Sharpness of digital image |
| 401 | 0.09 | 0.013 | C | A | A |
| 402 | 0.12 | 0.015 | B | A | A |
| 403 | 0.19 | 0.013 | A | A | A |
| 404 | 0.63 | 0.017 | A | A | A |
| 405 | 0.96 | 0.016 | A | B | B |
| 406 | 1.02 | 0.018 | A | B | C |
| 407 | 0.09 | 0.012 | C | A | A |
| 408 | 0.14 | 0.014 | A | A | A |
| 409 | 0.20 | 0.013 | A | A | A |
| 410 | 0.66 | 0.018 | A | A | A |
| 411 | 0.98 | 0.016 | A | A | A |
| 412 | 1.10 | 0.017 | A | C | C |
| 413 | 0.12 | 0.015 | A | A | A |
| 414 | 0.98 | 0.018 | A | A | A |
| Evaluating apparatus | AFM manufactured by Quesant Co. | Contact type surface roughness meter manufactured by Kosaka Laboratory Co., Ltd. | Modified NP3650 manufactured by Canon | | Digital modified NP6350 |

EXAMPLE

Now, the present invention will be described on the basis of examples and comparative examples.

Positively charging electrophotographic photosensitive members (Examples 1 through 4 and Comparative examples 1 through 3) were manufactured so that the photosensitive members had average inclinations Δa within a range of 10 μm×10 μm which were varied by modifying forms of cylindrical substrates of 80 mm diameter and the parameters of manufacturing conditions using the above described a-Si photosensitive film forming apparatus and abrading surfaces of formed deposited films with an SiC abrading tape.

Table 5 lists average inclinations Δa within the range of 10 μm×10 μm of the Examples 1 through 4 and Comparative examples 1 through 3, microscopic surface roughness Ra of electrically conductive substrates, values of reflection on interface according to equation (1) which was measured with a spectrophotometer and results of image evaluation.

Figure 8:
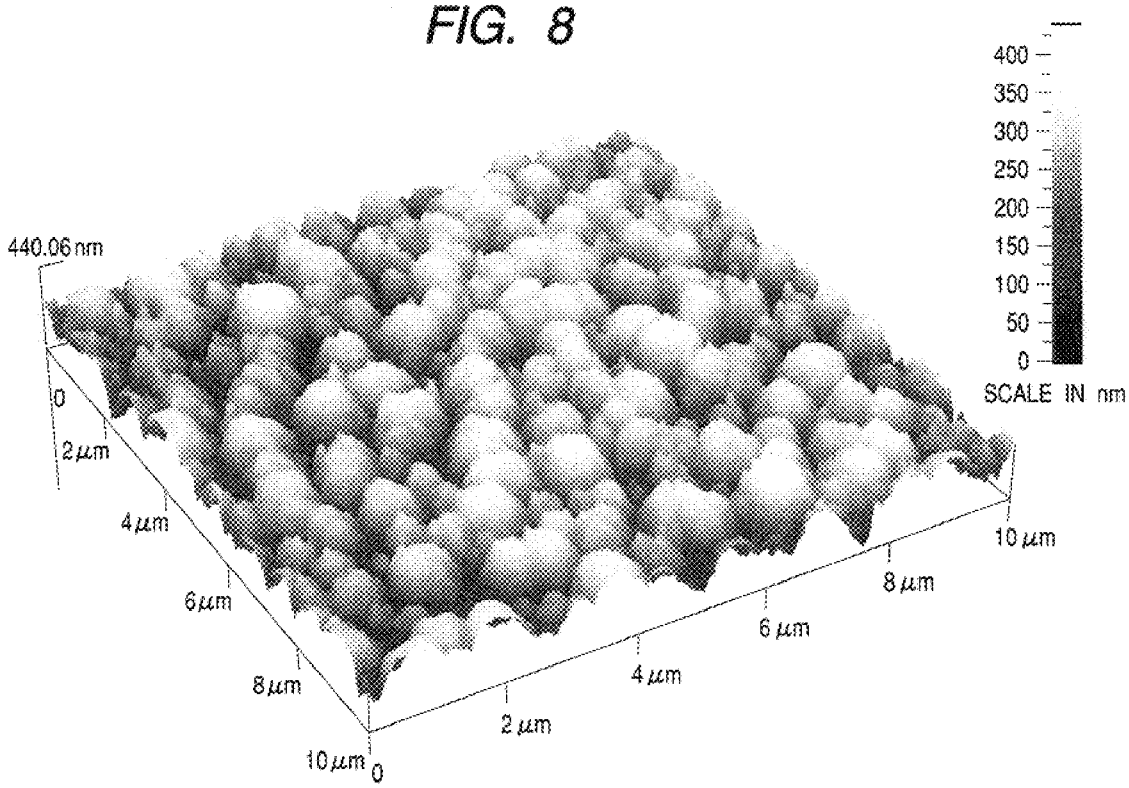
FIGS. 8, 9 and 10 are diagrams showing examples of images observed with an atomic force microscope.
Figure 9:
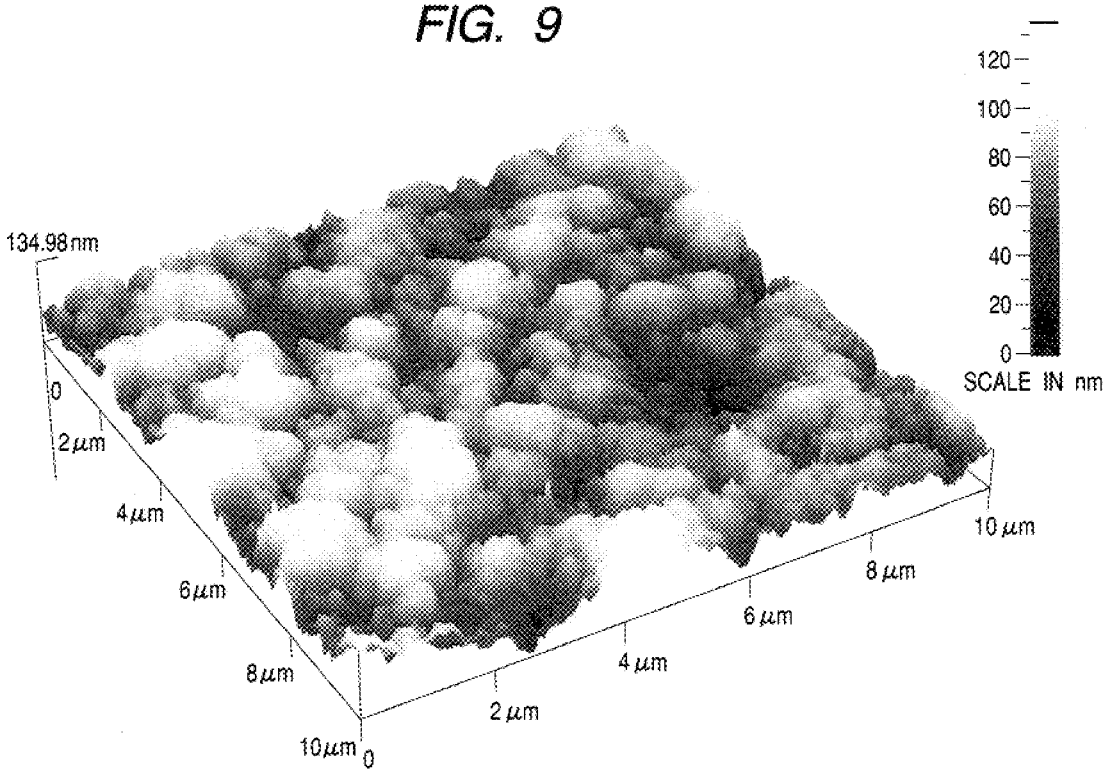
Figure 10:
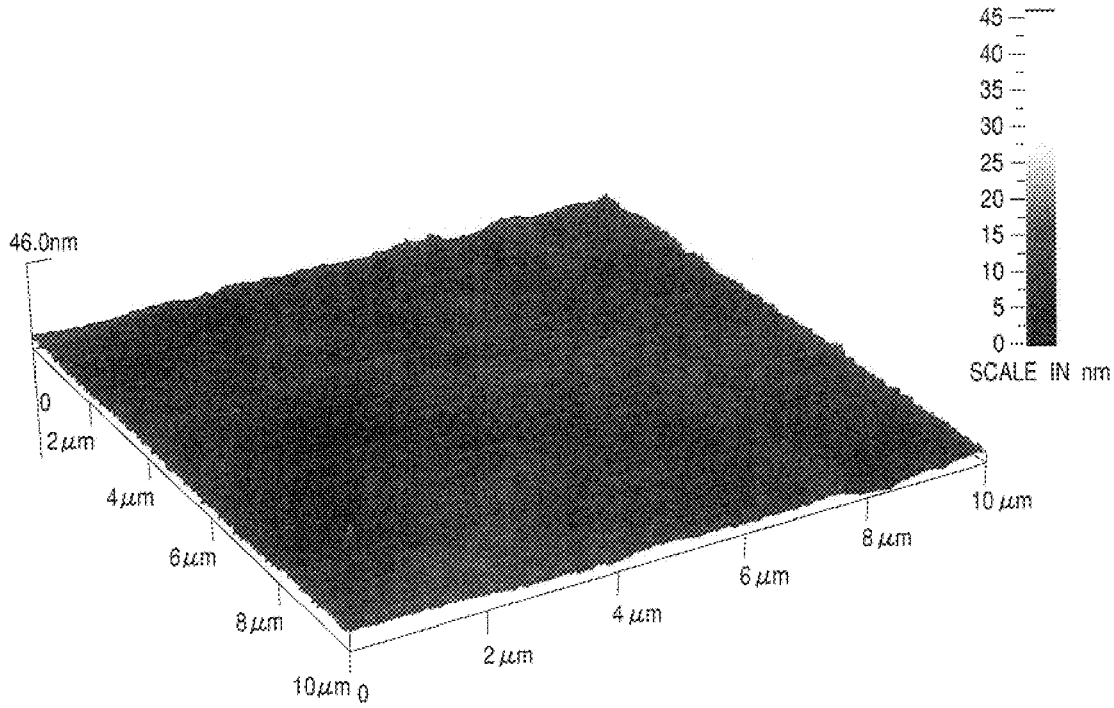
Figure 11:
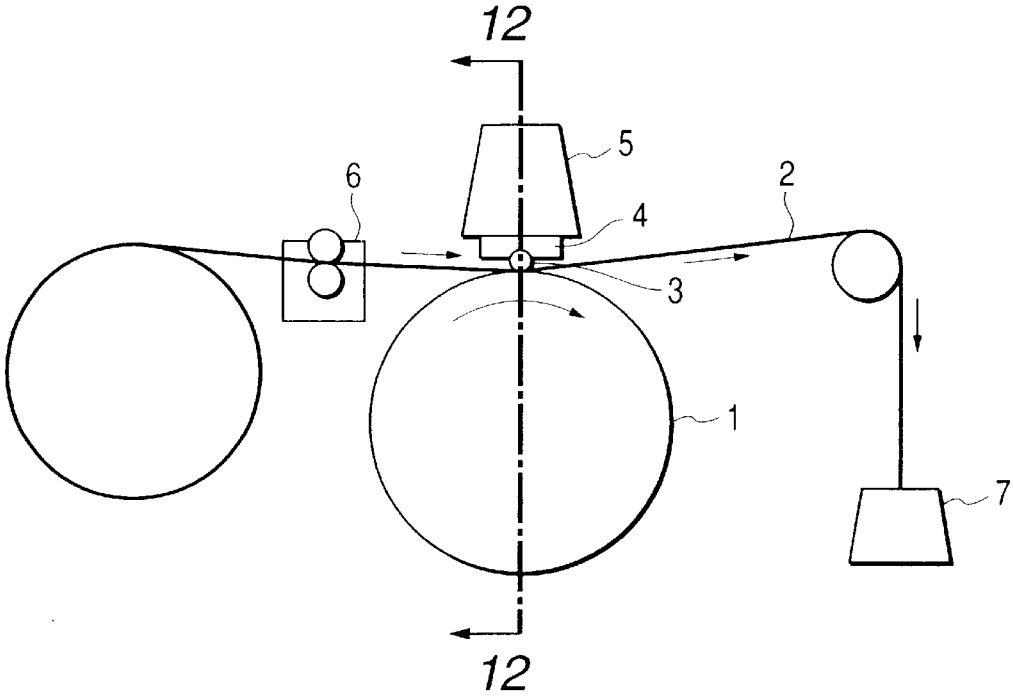
FIGS. 11 and 12 are diagrams descriptive of an example of abrading apparatus.
Figure 12:
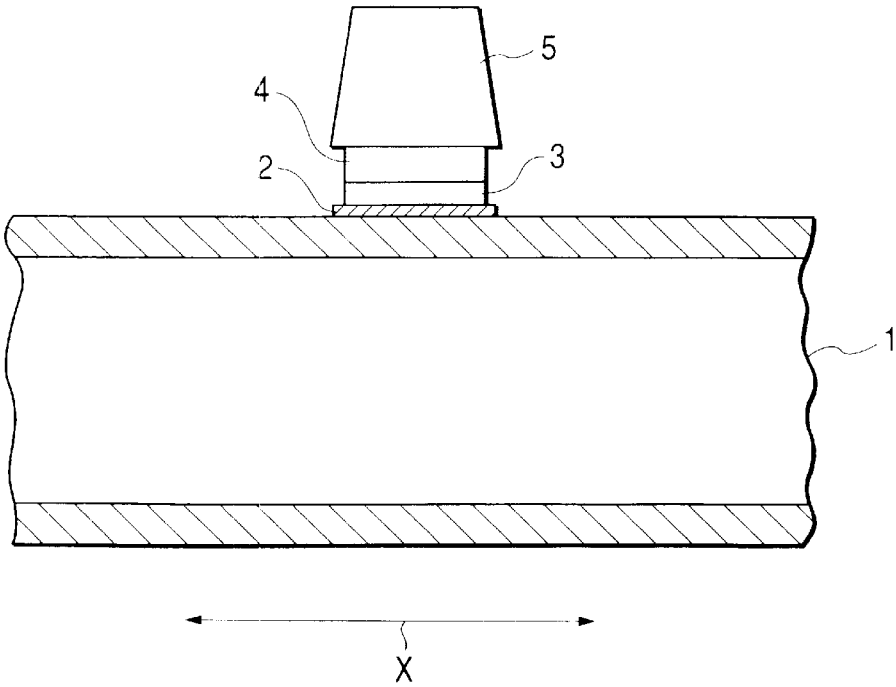

Furthermore, FIG. 10 shows observed image of microscopic roughness within a range of 10 μm×10 μm of a surface of an electrically conductive substrate used in Example 1 measured with the AFM, FIG. 9 shows an observed image of microscopic roughness within a range of 10 μm×10 μm of a surface of a photosensitive member used in Comparative example 1 and FIG. 8 shows an observed image of microscopic roughness within the range of 10 μm×10 μm of a photosensitive member used in Example 1 measured with the AFM.

As image evaluation, 1,000,000 sheets were passed for testing durability using Electrophotographic Apparatus NP 6350 manufactured by Canon, which was modified for digital exposure as shown in FIG. 5, toner adhesion, improper cleaning and sharpness of digital images were evaluated, and an overall evaluation was made from obtained results. In Example 2 and Comparative example 2, the modified Electrophotographic Apparatus NP 6350 manufactured by Canon was used and analog images were evaluated.

In Table 5, symbols are A: excellent, B: not problematic for practical use and C: may be problematic for practical use.

TABLE 5

| | Average inclination Δa at AFM level | Microscopic surface roughness of substrate [nm] | Value of reflection on interface according to equation (1) | Image evaluation | | | | |
|---|---|---|---|---|---|---|---|---|
| | | | | Toner adhesion | Improper cleaning | Improper spots | Sharpness of digital image | Overall evaluation |
| Example 1 | 0.36 | 5.9 | 0.45 | A | A | A | A | A |
| Example 2 | 0.36 | 5.9 | 0.45 | A | A | A | — | A |
| Example 3 | 0.35 | 8.5 | 0.42 | A | A | B | A | B |
| Example 4 | 0.13 | 5.9 | 0.28 | A | A | A | A | A |
| Comparative example 1 | 0.11 | 5.9 | 0.43 | C | A | A | A | C |
| Comparative example 2 | 0.11 | 5.9 | 0.43 | C | A | A | — | C |
| Comparative example 3 | 1.31 | 5.9 | 0.44 | A | B | A | C | C |
| Evaluating apparatus | AFM manufactured by Quesant Co. | | MCPD-2000 manufactured by Otsuka Electronics Co. | Modified NP6350 manufactured by Canon | | | | |

Example 5

Furthermore, negatively charged electrophotographic photosensitive members (Example 5 and Comparative example 4) was manufactured by appropriately adjusting a substrate form of cylindrical substrates having a diameter of 30 mm and the parameters of manufacturing conditions using the above described a-Si photosensitive member film forming apparatus and changing the condition of surface abrasion so that average inclinations within a range of 10 μm×10 μm of the photosensitive members were changed.

Table 6 lists average inclinations Δa of within the range of 10 μm×10 μm of Example 5 and Comparative example 4 respectively, microscopic surface roughness Ra of electrically conductive substrates, values of reflection on interface according to equation (1) which was measured with a spectrophotometer and results of image evaluations.

As image evaluations, 300,000 sheets were passed for testing durability using an apparatus provided by modifying the Electrophotographic Apparatus GP405 manufactured by Canon shown in FIG. 13, toner adhesion, improper cleaning and sharpness of digital images were evaluated, and overall evaluations were made from obtained results.

In Table 6, symbols are A: excellent, b: not problematic for practical use and C: may be problematic for practical use.

TABLE 6

| | Average inclination Δa at AFM level | Microscopic surface roughness of substrate [nm] | Value of reflection on interface according to equation (1) | Image evaluation | | | | |
|---|---|---|---|---|---|---|---|---|
| | | | | Toner adhesion | Improper cleaning | Improper spots | Sharpness of digital image | Overall evaluation |
| Example 5 | 0.35 | 5.5 | 0.35 | A | A | A | A | A |
| Comparative example 4 | 0.10 | 5.5 | 0.30 | C | A | A | A | C |
| Evaluating apparatus | AFM manufactured by Quesant Co. | | MCPD-2000 manufactured by Otsuka Electronics Co. | Modified GP405 manufactured by Canon | | | | |

Though the fifth example was cleanerless type, the fifth example was capable of maintaining image fog at a favorable level, preventing toner adhesion even at locations of a charging roller and a transferring roller, and outputting extremely stable images for a long time.

Example 6

Extremely stable images could be output for a long time while images were evaluated in conditions similar to those described in Example 5, except for photosensitive members which used light transmitting substrate (glass in this case) shown in FIG. 6 and applied to the apparatus shown in FIG. 6.

Also in Example 6, surfaces of films deposited on the substrates were abraded using an SiC abrading tape to obtain an average inclination Δa of 0.35 within the range of 10 μm×10 μm.

The electrophotographic photosensitive member and the electrophotographic apparatus according to the present invention which adjust an average inclination Δa within a range of 0.12 to 1.0, more preferably 0.15 to 0.8 within a range of 10 μm×10 μm of a photosensitive member composed by consecutively laminating at least a photosensitive layer containing Si and a surface protective layer on electrically conductive substrate are capable of forming favorable images by preventing toner adhesion.

Furthermore, the electrophotographic photosensitive member and the electrophotographic apparatus according to the present invention are capable of preventing the toner adhesion more effectively and enhancing image sharpness when a photoconductive layer of the above described photosensitive member consists of a plurality of layers.

Furthermore, the electrophotographic photosensitive member and the electrophotographic apparatus according to the present invention are capable of forming more favorable images by preventing toner adhesion and improper spots at a cleaning time when surface roughness Ra is lower than 9 nm, more preferably lower than 6 nm within a range of 10 μm×10 μm of an electrically conductive substrate and an average inclination Δa is within a range of 0.12 to 1.0, more preferably 0.15 to 0.8.

Furthermore, when a composition of an interface between the surface protective layer and the photosensitive layer of the above described photosensitive member is continuously changed, and when the above described composition of the interface has spectral reflectance satisfies an equation shown below fort rays having wavelengths within a range of 450 nm to 650 nm, the electrophotographic photosensitive member and the electrophotographic apparatus according to the present invention are capable of preventing toner adhesion more effectively:

$$0 \leqq (Max-Min)/(Max+Min) \leqq 0.4$$

wherein reference character Max denotes a maximum value of the reflectance and reference character Min denotes a minimum value of the reflectance.

What is claimed is:

1. An image forming apparatus comprising:

a photosensitive member composed by consecutively laminating at least a photoconductive layer containing amorphous Si and an abraded surface protective layer on an electrically conductive substrate;

a charger for charging said photosensitive member;

an exposing device for forming an electrostatic latent image on said photosensitive member which is charged; and a developing device for visualizing said electrostatic latent image with a developer, wherein an average inclination Δa within a range of 10 μm×10 μm of the surface of said photosensitive member is within a range of 0.12 to 1.0 by abrading the surface of the photosensitive member, wherein said average inclination Δa is calculated from three dimensional forms measured with an atomic force microscope, wherein said developer used in said developing device contains a toner and charging acceleration particles having electrical conductivity, and wherein said charger is an electrically conductive elastic contact charging roller comprising a medium resistance layer of rubber or foaming material on a core metal as a flexible member, and the medium resistance layer having a resistance from $1\times10^4$ to $1\times10^7$ Ω.

2. The image forming apparatus according to claim 1, wherein said developing device of the image forming apparatus serves also as a cleaning device for removing a toner which remains on the photosensitive member after transferring a toner image to a recording medium.

3. The image forming apparatus according to claim 1, wherein said exposing device has a light source which emits rays mainly having a wavelength.

4. The image forming apparatus according to claim 3, wherein said light source is a LED or a laser beam.

5. The image forming apparatus according to claim 1, wherein said electrically conductive substrate has a light transmitting substrate and a light transmitting electrically conductive layer, and said exposing device for projecting rays toward the photoconductive layer through said light transmitting substrate is a LED head.

6. The image forming apparatus according to claim 1, wherein said exposing device is a LED head or a laser beam scanner.

7. The image forming apparatus according to claim 1, wherein said charging acceleration particles which adhere to a surface of a photosensitive member in a developing portion remain on the surface of the photosensitive member even after transferring, and said charging acceleration particles are brought and interposed at least into a nip portion between the contact charging roller and the photosensitive member.

* * * * *